United States Patent [19]

Gajjar

[11] 4,015,451

[45] Apr. 5, 1977

[54] WARP KNIT FABRIC

[75] Inventor: Bharat Jaybhadra Gajjar, Wilmington, Del.

[73] Assignee: E. I. Du Pont de Nemours and Company, Wilmington, Del.

[22] Filed: Oct. 8, 1975

[21] Appl. No.: 620,836

[52] U.S. Cl. ..... 66/195

[51] Int. Cl.[2] ..... D04B 21/00

[58] Field of Search ..... 66/86–89, 66/190–195

[56] References Cited

UNITED STATES PATENTS

| | | | |
|---|---|---|---|
| 1,234,927 | 7/1917 | Myers et al. | 66/195 |
| 2,932,181 | 4/1960 | MacCafflay | 66/84 R |
| 3,055,196 | 9/1962 | Brenner et al. | 66/86 R |
| 3,063,272 | 11/1962 | Bolton | 66/86 |
| 3,254,510 | 6/1966 | Lesley | 66/195 |
| 3,255,615 | 6/1966 | Schwartz | 66/195 X |
| 3,861,175 | 1/1975 | Farmer | 66/86 A |

*Primary Examiner*—Ronald Feldbaum

[57] ABSTRACT

A warp knitted fabric with surface interest patterning is formed from full sets of warp threads of yarn. The surface interest patterning is continuous throughout the length of the fabric and includes groups of wales, each group being separated from adjacent wales by exaggerated spacing. Three different methods for obtaining the surface interest patterning on a two-bar single needle bed warp knitting machine are disclosed.

13 Claims, 19 Drawing Figures

STITCH
FRONT BAR
BACK BAR

JERSEY
2-3, 1-0
1-0, 1-2
41
42

MODIFIED JERSEY
1-0, 2-3
2-3, 1-0

REVERSE JERSEY
1-0, 1-2
2-3, 1-0

LONG-FLOAT JERSEY
3-4, 1-0
1-0, 1-2

STABILIZED
1-0, 0-1
3-4, 1-0

TAFFETA
1-0, 0-1
1-0, 4-5

SHORT-FLOAT DELAWARE
1-2, 1-0
1-0, 0-1

DELAWARE
2-3, 1-0
1-0, 0-1

LONG-FLOAT DELAWARE
3-4, 1-0
1-0, 0-1

SATIN-FLOAT DELAWARE
4-5, 1-0
1-0, 0-1
0 1 2 3 4 5
0 1 2 3 4 5

WARP KNIT FABRIC

BACKGROUND OF THE INVENTION

This invention relates to warp knitted fabrics and more particularly to warp knitted fabrics with surface interest patterning.

Basic warp-knitting, to which this invention applies, comprises knitting on tricot or Raschel machines using basic plain stitches, for example, Jersey or Delaware stitches, or their well-known variations. These knitted fabrics are characterized by unvarying stitch formation; i.e., all stitches in a given course are identically formed, and each course is formed exactly the same as alternating courses before and after it in the fabric. The front-bar and back-bar stitch patterns are different, but each starts in one course, generally ends in the next, and repeats for succeeding pairs of courses. Basic warp-knitting permits very high production rates, but the fabrics have only plain surface aesthetics free of any surface-interest patterning. The prior art includes many techniques for forming surface patterns in warp-knitted fabrics, but all of these known techniques involve complicated variation in stitch patterns, the laying in of extra ends or the omission of ends in pattern-forming arrays, or like complications which diminish productivity and add to the cost of fabrics produced.

SUMMARY OF THE INVENTION

This invention provides a warp knitted fabric of full sets of front and back bar warp threads of yarn knitted in courses according to a stitch pattern forming spaced wales of knitted loops and having a continuous pattern throughout its length. The pattern includes at least one group of wales separated from adjacent wales by exaggerated spacing. In addition the knitted loops vary in shape, size, orientation and spacing course-wise in a sequence which repeats in alternate courses when knitted with basic warp knitting stitches as hereinafter described.

Almost any yarns useful for known warp knit processing may be used in making fabric according to this invention. Included are synthetic thermoplastic yarns in either filament or spun staple form, yarns spun from natural fibers, and yarns from mixtures of synthetic and natural fibers.

The fabric, in accordance with the invention, is preferably made on a tricot or similar warp knitting machine employing a single needle bar and at least two yarn guide bars respectively known as the back guide bar and the front guide bar. The needle bar is provided with knitting needles which may vary in number according to the gauge of the machine, and each guide bar has a number of yarn guides corresponding to the number of needles of the needle bar. The guide bars are able to be shogged under control a distance of one or more needles in opposite directions lengthwise of the needle bar, and both guide bars are also swingable transversely of the needle bar to permit their yarn guides to pass between the needles, the combined shogging and swinging movements permitting the yarns to be fed to the needles and to be knit thereby.

Three methods for knitting the fabrics of this invention are described herein:

1. In a fully threaded two guide bar warp knitting machine by supplying one of the full sets of threads to one of the guide bars from two partial sets of threads, i.e., a mixed feeding of one guide bar. The partial sets of threads are fed at different rates to the guide bar in a pattern wherein predetermined groups of adjacent threads from one partial set of threads are separated from each other by at least one thread from the other partial beam set of threads.

2. In a fully threaded two guide bar warp knitting machine by interchanging some of the threads from one guide bar with threads from the other guide bar in a spaced pattern ahead of the guide bars on the knitting machine.

3. In a fully threaded two guide bar warp knitting machine by feeding a partial beam set of threads to spaced positions on one or the other of the guide bars, i.e., partial double-ending one guide bar such that spaced doubled ends are knitted together as a single end. The partial beam set of threads is fed at a different rate from the full beam set of threads.

DETAILED DESCRIPTION OF THE PREFERRED EMBODIMENT

"Basic warp-knitting", as intended herein, is best defined in terms of stitch patterns, as shown in FIGS. 1A to 1J. While many other patterns constituting basic warp-knitting are theoretically possible, the ones shown represent most of those used commercially. For each, a single needle-bar is normally employed, being fed from a front-bar and a back-bar of knitting yarns. Knitting needle positions for each of two successive courses are represented in the diagrams by horizontal lines of dots, the top line representing the course formed immediately after the course represented by the bottom line. Only one front-bar end and one back-bar end are shown in each instance, it being understood that one end of each is knitted on each knitting needle for every course. More particularly, referring to FIG. 1A, the stitch construction of the fabric is notationally set out and shows that the threads of the front bar, one of which is indicated at 41, have back and forth movement to non-adjacent needles in successive courses as indicated by the numbers 2-3,1-0 and that the threads of the back bar, one of which is indicated as 42, have similar movements as indicated by the numbers 1-0,1-2. The Delaware stitches are particularly characterized by chain-stitched back-bar threads as indicated by the numbers 1-0,0-1 (FIGS. 1G–1J). These may be open stitches (as shown) or closed loops.

Figure 2:
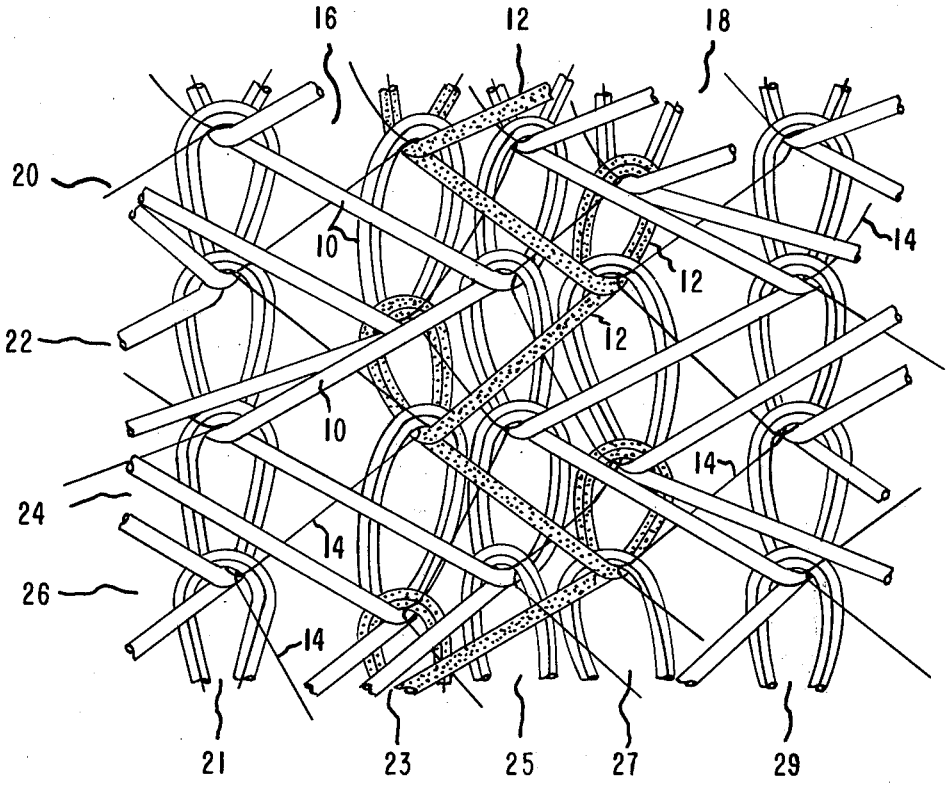
FIG. 2 is a diagrammatic representation of a portion of a two bar warp-knit fabric having knitted loops of Jersey stitches formed from fully threaded front and back guide bars wherein the front guide bar is fed from two partial sets of threads in a pattern.

FIG. 2 schematically illustrates a two bar warp-knitted fabric prepared by the mixed feed method wherein a single needle bed warp knitting machine is employed and three warp sets of threads are supplied. More particularly, threads 10 are supplied from a front beam to the front guide bar leaving preselected spaced positions open, threads 12 are supplied from a middle beam also to the front guide bar to the preselected open positions rendering the front guide bar fully threaded, and threads 14 are supplied from a back beam to fully thread the back bar. Threads 12 are more highly tensioned than threads 10, which is accomplished by feeding the threads 10 and 12 at different rates, which in turn provides the difference in tension. One method of setting forth this difference in tension is by the ratio R of the runner length of threads 12 from the middle beam to the runner length of threads 10 from the front beam. Runner length is the length of each yarn used in knitting one rack (480 consecutive courses) of stitches. Thus, for the mixed feed technique of FIG. 2 the ratio R is less than one. The guide bars are so threaded and shogged that the stitch pattern is a Jersey stitch with a 2-3,1-0 fully threaded front bar pattern and a 1-0,1-2 fully threaded back bar pattern knit in courses 20, 22, 24, and 26 of wales 21, 23, 25, 27 and 29 wherein the back or float side of the fabric is shown for clarity. It will be noted that the fabric has a pattern throughout its length of a group of wales 23, 25, 27 separated form adjacent wales 21 and 29 by exaggerated spaces 16 and 18. In addition the knitted loops within the pattern vary course-wise in shape size and orientation in a sequence which repeats in alternative courses. More particularly, the sequence of the loops of wales 23, 25, 27 in course 20 progressing from large to small and being canted toward wale 29 is repeated in course 24 whereas the opposite sequence is found in alternate courses 22 and 26.

FIGS. 3–10 are enlarged photographs of portions of fabric produced according to the above described different methods and, as can be seen, all exhibit the exaggerated wale spacing with the knitted loops varying in shape, size, orientation and spacing in a sequence which repeats in alternate courses. These FIGS. are described in more detail in the following examples.

Surface-effect patterning superficially resembling the patterning of this invention has been produced, heretofore, either by omitting spaced threads in a guide bar or by using complicated stitch constructions. Both of these known approaches undesirably modify the visual and tactile aesthetics recognized as attributes of basic Jersey and Delaware-stitch fabrics. Strips formed by omitting ends are so deficient in density as to provide substantially no fabric cover (opacity). Moreover, they adversely affect fabric drape; and they require a supply of special beams with selected ends missing, which is not practical commercially. Use of complicated stitch constructions to impart patterning drastically modifies tactile aesthetics and also necessitates knitting at lower, more expensive rates. The fabrics of the present invention not only retain the tactile and visual aesthetics of prior art fabrics knitted using the same basic knitting stitches, but they also provide surface-interest patterning. Thus, for the first time, basic warp knits can be used where their tactile aesthetics are desired but where their lack of surface patterning has heretofore prevented use.

Conventional finishing procedures are suitable for greige fabrics of this invention. In the examples, except for random selection of color of the disperse dyes used, all greige fabrics are finished identically. After heat setting for 30 seconds at 380° F (193° C) on a pin tenter frame at 10% overfeed and 5% underwidth, they are scoured, washed, dyed, and again washed in a beck. Scouring is for 30 minutes at 180° F (82° C) using an aqueous dispersion of surfactant and emulsified hydrocarbon scouring solvent. Initial washing is for 20 minutes at 160° F (71° C) in water containing detergent. After 5 minutes at 120° F (49° C) in water containing wetting agent, dispersing agent, and a dye assist, pH is adjusted to 6 with acetic acid, the selected dye is added, and temperature is raised to 160° F (71° C) before adding butyl benzoate dye carrier. Dyeing continues at the boil for 90 minutes. Final washing identical to initial washing ends treatment in the beck. Finishing is completed by heat setting at 350° F (177° C) on a pin tenter frame at wet width and 5% overfeed.

The following terms are used in the Examples and are defined below:

Rack is defined a 480 consecutive courses (knitted rows) of stitches.

Runner length is the length of each yarn used in knitting one rack.

Quality denotes the length of one rack of knitted fabric.

Guage specifies the number of knitting needles per inch (per 2.54 cm) in the needle bar.

Count (W/C) specifies the number of wales (W) and courses (C) per unit of length measured perpendicular to the fabric direction of each.

Greige (also, occasionally, "gray") describes untreated fabric just as it comes from the knitting machine. Before it is sold, the greige fabric is ordinarily treated by washing, scouring, dyeing, heat-setting, or the like, after which it is referred to as "finished" fabric.

Bulk is computed from weight per unit area, W, and from thickness, $t$, according to Bulk = $(t/W)\times$(units conversion factor). When W is given in oz/yd$^2$ and $t$ in inches, Bulk in cc/gm is computed from $$\text{Bulk} = (t/W) \times 748.5.$$

In the examples, Yarns A and B are both of 30 denier (33.3 dtex) and are prepared substantially as described in Example I of Knospe, U.S. Pat. No. 3,416,302. Each filament has a trilobal cross-section as taught by Holland in U.S. Pat. No. 2,939,201. Yarn A has 10 filaments, and Yarn B has 18 filaments. In each yarn half of the filaments are composed substantially of PACM-12 homopolymer and the other half of PACM-12/PACM-I (90/10 by weight) copolymer. PACM denotes the polymer unit corresponding to bis-(4-aminocyclohexyl) methane; 12 denotes the polymer unit corresponding to dodecanedioic acid; and I denotes the polymer unit corresponding to isophthalic acid. The PACM employed contains 70% by weight of its trans-trans isomer.

Yarn C is provided on partial beams only and is a commercially available crimped 30 denier (33.3 dtex) round cross-section monofilament of poly-E-caproamide. It is crimped as described by Rice in U.S. Pat. No. 3,256,134.

In Examples I-V the fabrics are warp knitted using standard two-bar, fully threaded, tricot knitting machines. The top and back beams in each case feed normally beamed knitting yarns of the same description. As specified, three basic warp knitting stitches are employed with the following front bar/back bar knitting patterns:

Jersey stitch: 2-3,1-0/1-0,1-2

Delaware stitch: 2-3,1-0/1-0,0-1

Modified Jersey: 1-0,2-3/2-3,1-0.

In each case, the only modification to otherwise standard and well-known knitting is the interchanging (crossing) of corresponding spaced front and back bar threads at a point between the respective beams and guide bars. The arrangement for crossing spaced threads is substantially as discussed in connection with FIG. 3. The distribution of crossed threads along consecutive guides in either guide bar is indicated by a series of symbols (O or X) where "O" denotes a normally threaded end and "X" denotes a cross thread, i.e., thread originating from the opposite beam from that which normally feeds the guide bar involved. Thus, OOXOOOXOOOOX represents a repeated distribution along successive positions on either guide bar where two threads are normally threaded, one is crossed, three are normally threaded, one is crossed, four are normally threaded, and one is crossed. Unlike customary Jersey or Delaware stitch fabrics, the fabrics of the examples exhibit attractive longitudinal wale-shifted patterning which is readily varied for a multiplicity of patterned effects by selection of the spacing of crossed ends and the type of stitch employed. While, in the examples, the top and back bar ends are identical, it is obvious that further enhancement of the pattern occurs if the top and back bar ends differ in color or dyeability.

EXAMPLE I

A 28-gauge, fully threaded tricot knitting machine is employed to produce three fabrics as identified in Table 1. (Table 1*a* being the metric conversion for Table 1) Yarn A, as previously described, is used throughout. Every other end is crossed (OxOx, etc.) in bands ten or more wales wide separated by much wider portions of normally knit fabrics. Fabrics I-A and I-B use the modified Jersey stitch, and Fabric I-C uses the Jersey stitch.

Fabrics I-A and I-B, differing only in quality, runner lengths, and resulting weights, have particularly striking and attractive patterning within the bands containing the crossed ends. On the loop sides, normally knit wales are characterized by loops which zig-zag alternately right and left, all loops in a given course canted in the same direction. In the bands containing crossed ends, however, the same zig-zag of loops along a given wale occurs but adjacent loops along a given course are canted in opposite directions. The result is a very open, mesh-like appearance heretofore unobtainable by basic tricot knitting. Moreover, each band has at its juncture with normally knit portions a wale with uncanted loops which frames the band in the fabric. It is apparent that bands of any width, including the full fabric width, can be so prepared.

Fabric I-C also has visible patterning bands, but they are not so strikingly differentiated from normally knit areas. Use of the Jersey stitch with alternating crossed ends provides more subdued patterns of longitudinal bands.

EXAMPLE II

A 32-gauge fully threaded tricot knitting machine is used to produce three fabrics with every 32 end crossed. Fabric II-A is prepared using the Jersey stitch, and Fabrics II-B and II-C using the Delaware stitch. Each is further described in Tables 1 and 1*a*. Yarn B, as previously defined, was used throughout.

In all three fabrics narrow stripes of very tightly associated three-wale groupings are formed, each grouping including a crossed end and extending the full length of the fabric. Interwale spacings on each side of each grouping are wider than in the normally knit areas, thus accentuating the longitudinal, visually striped effect. The maximum float size in both Jersey and Delaware stitches is three needles wide, the crossed end having this float size accounting for the presence of three tightly spaced wales in the grouping. Four-needle floats produce four-wale groupings, etc. The number of normally knit wales between crossed ends may be varied to produce a variety of numbers and spacing of wale-grouped fabrics.

EXAMPLE III

Except for the spacing of crossed ends, four more fabrics are prepared as in Example II and as characterized in Tables 1 and 1*a*. Fabrics II-A, III-B, and III-C use the Delaware stitch; Fabric III-D uses the Jersey stitch. Except for differences in quality, runner length, and weight Fabrics III-A, III-B, and III-C have equivalently patterned effects, but Fabric III-D is quite different. In all cases, the full fabric width is divided into six zones, each zone differing in spacing of crossed ends with the following regular repeating patterns; each pattern repeated:

| | |
|---|---|
| Zone 1 | 00X |
| Zone 2 | 000X |
| Zone 3 | 00000X |
| Zone 4 | 0000000X |
| Zone 5 | 0000000000X |
| Zone 6 | 000000000000000X |

Considering the Delaware-stitch fabrics first, Zone 1 exhibits only a series of groupings of tightly associated three-wale bands, each band separated from the next by extra-wide interwale spacings. Zone 2 has tight three-wale groupings alternating with single normally knit wales, interwale spacings on each side of each three-wale grouping being extra-wide. Zone 3 is similar, having three normally knit and spaced wales between three-wale groupings. Zone 4 continues the same pattern, having five normally knit and spaced wales between three-wale groupings.

Figure 3:
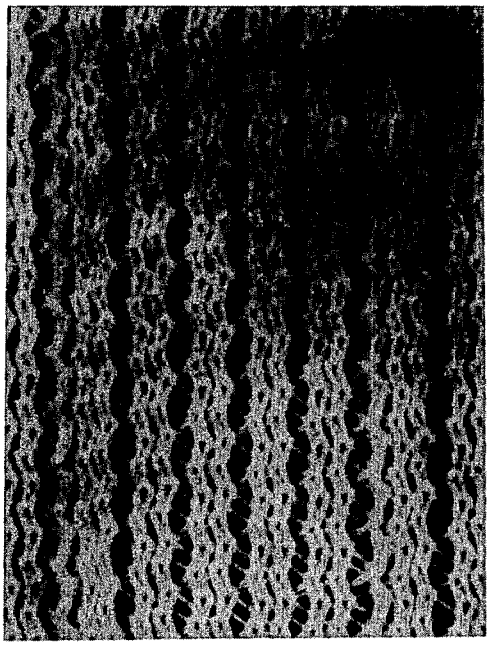
FIGS. 3 and 4 are photographs of fabrics made as described in Example III by interchanging threads from one guide bar to another.

Zone 5 (as shown in FIG. 3) shows a new effect of spontaneous additional wale-shifting in the normally knit wales between three-wale groupings. Delaware-stitch fabrics have an inherent tendency to form random two-wale groupings. As seen in FIG. 3, when the ends are crossed to form three-wale groupings, the intervening normally knit wales also regularly associate into two-wale groupings continuously and uniformly throughout the length of the fabric. This additional wale-shifting occurs when an even number of normally knit wales is left between three-wale groupings. Although not shown in the Table, two two-wale groupings occur between adjacent three-wale groupings when every seventh end is crossed. Thus, additional two-wale wale-shifted groupings occur when an even number (>2) of normally knitted wales are formed between crossed ends. The effect using Long Float Delaware stitch (4-needle float ) is analogous except that the groupings including crossed ends are composed of four wales and the additional groupings have three wales each. Thus, when every seventh or every eleventh end is crossed using Long Float Delaware stitch, one or two extra three-wale groupings are formed between the always obtained four-wale groupings including crossed ends.

Zone 6, having fifteen normally knit wales between crossed ends, shows a combination of these two effects. As in the previous fabrics, three-wale groupings including the crossed ends form. With such wide spacing between crossed ends, however, the fabric does not "know" whether there is an odd or even number of intervening wales. It therefore forms extra two-wale groupings on either side of the three-wale groupings. The remaining wales are substantially normally knitted and spaced.

Figure 4:
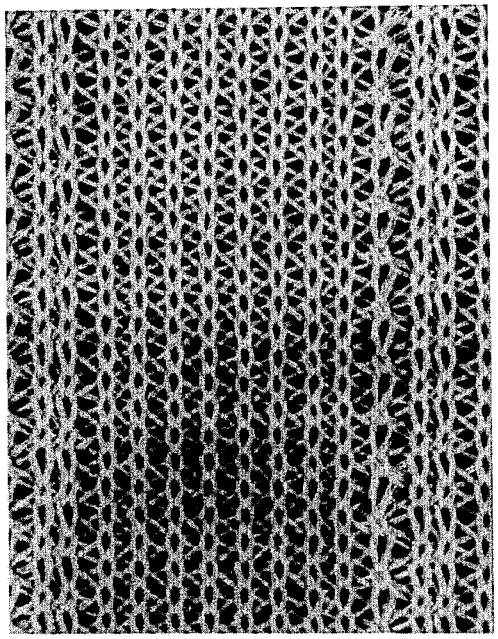

All Zones for Jersey-stitch Fabric III-D show similar effects except that no additional wale shifting occurs between three-wale groupings including crossed ends. The three-wale groupings for these Jersey fabrics, however, are split into a single wale with relatively large stitch loops and a two-wale group of distorted stitch loops, the remaining wales, if any, between adjacent crossed ends being normally knit and spaced. FIG. 4 shows Zone 5 of Fabric III-D.

EXAMPLE IV

Except for the spacings of crossed ends, these fabrics are prepared as described in Examples II and III. Fabrics IV-B uses Jersey stitch, the remaining three use Delaware stitch. In all four fabrics, the spacing of crossed ends is in the following irregular repeating pattern across the full fabric width:

OXOOXOXOOXOOOOOO.

A complicated combination of previously obtained longitudinally striped effects is obtained.

Jersey Fabric IV-B exhibits no exaggerated interwale spacings. Instead it has groups of seven normally knit and spaced wales separated by groups of nine wales having varying degrees and types of distorted stitches.

The three Delaware-stitch fabrics all show distinct interwale spacing between groups of wales. Each shows a group of five normally knit and spaced wales separated from a wide, a still wider, and another wide close grouping or wales, in order. These multiple groupings provide a distinct and attractive pattern of uniform longitudinal bands.

EXAMPLE V

This example is just like Example IV except for a different spacing of crossed ends across the fabric width. The repeat pattern is

OOOXOX.

Fabric V-B made using Jersey stitch, and Fabrics V-A and V-C with Delaware stitch. Although there are visually apparent stitch distortions along wales including crossed ends, Fabric V-B shows no spaced groupings. Fabrics V-A and V-C, however, show dense wale groupings alternating with single wales and separated from them by pronounced interwale spacings.

TABLE 1

| Fabric | Runner Length (in.) Top Bar | Runner Length (in.) Back Bar | Greige Properties Quality (in.) | Greige Properties Width (in.) | Greige Properties Weight (oz./yd.²) | Greige Properties Count (W/C) (in.⁻¹) | Finished Properties Width (in.) | Finished Properties Weight (oz./yd.²) | Finished Properties Count (W/C) (in.⁻¹) |
|---|---|---|---|---|---|---|---|---|---|
| I-A | 72.5 | 57.5 | 8 | 30 | 2.22 | 39 × 51 | 25.5 | 1.85 | 45 × 41 |
| I-B | 72.5 | 55 | 10 | 29 | 2.25 | 39 × 53 | 25 | 2.12 | 45 × 45 |
| I-C | 70 | 56.25 | 10 | 33.25 | 2.15 | 40 × 50 | 25 | 2.18 | 46 × 44 |
| II-A | 58 | 42 | 8 | 67 | 2.07 | 41 × 60 | 55 | 2.45 | 46 × 62 |
| II-B | 50 | 36.5 | 6 | 77.25 | 2.22 | 34 × 86 | 61.5 | 2.64 | 42 × 85 |
| II-C | 48 | 36 | 5.5 | 75.5 | 2.33 | 35 × 95 | 64.38 | 2.72 | 40 × 93 |
| III-A | 66 | 54 | 12 | — | — | — | 15.75 | 1.55 | 39 × 41 |
| III-B | 63 | 45 | 10 | — | — | — | 15.75 | 1.77 | 38 × 56 |
| III-C | 60 | 41 | 8 | 18 | 1.94 | 35 × 65 | 15.5 | 2.05 | 36 × 65 |
| III-D | 63 | 46 | 9.75 | 16 | 2.10 | 44 × 50 | 14 | 1.61 | 38 × 50 |
| IV-A | 64 | 39 | 7.75 | 39 | 1.88 | 34 × 64 | 35.5 | 2.30 | 36 × 70 |
| IV-B | 60.75 | 43.5 | 7.75 | 33 | 2.20 | 39 × 60 | 26.88 | 2.48 | 47 × 62 |
| IV-C | 68 | 42 | 9 | 39.25 | 1.74 | 32 × 56 | 36.5 | 2.17 | 35 × 62 |
| IV-D | 58 | 34.25 | 6.88 | 37.5 | 2.03 | 32 × 74 | 31.5 | 2.73 | 34 × 87 |
| V-A | 64 | 39 | 7.75 | 33.25 | 2.29 | 37 × 67 | 29.5 | 3.07 | 41 × 82 |
| V-B | 60.75 | 43.5 | 7.75 | 31.75 | 2.28 | 36 × 64 | 28.25 | 2.68 | 48 × 66 |
| V-C | 68 | 42 | 9 | 33.5 | 2.07 | 37 × 60 | 31 | 2.65 | 41 × 70 |

TABLE 1a

| Fabric | Runner Length (m.) Top Bar | Runner Length (m.) Back Bar | Quality (cm.) | Metric Conversions Greige Properties Width (m.) | Metric Conversions Greige Properties Weight (gm/100 cm²) | Metric Conversions Greige Properties Count (W/C cm⁻¹) | Finished Properties Width (m.) | Finished Properties Weight (gm/100cm²) | Finished Properties Count (W/C cm⁻¹) |
|---|---|---|---|---|---|---|---|---|---|
| I-A | 1.842 | 1.467 | 20.3 | .762 | .753 | 15.4 × 20.1 | 0.648 | .628 | 17.7 × 16.1 |
| I-B | 1.842 | 1.397 | 25.4 | .737 | .764 | 15.4 × 20.9 | 0.635 | .719 | 17.7 × 17.7 |
| I-C | 1.778 | 1.429 | 25.4 | .845 | .730 | 15.7 × 19.7 | 0.635 | .740 | 18.1 × 17.3 |
| II-A | 1.473 | 1.067 | 20.3 | 1.702 | .702 | 16.1 × 23.6 | 1.397 | .831 | 18.1 × 24.4 |
| II-B | 1.270 | 0.927 | 15.2 | 1.962 | .753 | 13.4 × 33.9 | 1.562 | .896 | 16.5 × 33.5 |
| II-C | 1.219 | 0.914 | 14.0 | 1.918 | .791 | 13.8 × 37.4 | 1.635 | .923 | 15.7 × 36.6 |
| III-A | 1.676 | 1.372 | 30.5 | — | — | — | 0.400 | .526 | 15.4 × 16.1 |
| III-B | 1.600 | 1.143 | 25.4 | — | — | — | 0.400 | .601 | 15.0 × 22.0 |
| III-C | 1.524 | 1.041 | 20.3 | 0.457 | .658 | 13.8 × 25.6 | 0.394 | .696 | 14.2 × 25.6 |
| III-D | 1.600. | 1.168 | 24.8 | 0.406 | .713 | 17.3 × 19.7 | 0.356 | .546 | 15.0 × 19.7 |
| IV-A | 1.626 | 0.991 | 19.7 | 0.991 | .638 | 13.4 × 25.2 | 0.902 | .781 | 14.2 × 27.6 |
| IV-B | 1.543 | 1.105 | 19.7 | 0.838 | .747 | 15.4 × 23.6 | 0.683 | .842 | 18.5 × 24.4 |
| IV-C | 1.727 | 1.067 | 22.9 | 0.997 | .590 | 12.6 × 22.0 | 0.927 | .736 | 13.8 × 24.4 |
| IV-D | 1.473 | 0.870 | 17.5 | 0.953 | .689 | 12.6 × 29.1 | 0.800 | .926 | 13.4 × 34.3 |
| V-A | 1.626 | 0.991 | 19.7 | 0.845 | .777 | 14.6 × 26.4 | 0.749 | 1.042 | 16.1 × 32.3 |
| V-B | 1.543 | 1.105 | 19.7 | 0.806 | .774 | 14.2 × 25.2 | 0.718 | .909 | 18.9 × 26.0 |

TABLE 1a-continued

| Fabric | Runner Length (m.) Top Bar | Runner Length (m.) Back Bar | Quality (cm.) | Metric Conversions Greige Properties Width (m.) | Weight (gm/100 cm²) | Count (W/C cm⁻¹) | Finished Properties Width (m.) | Weight (gm/100cm²) | Count (W/C cm⁻¹) |
|---|---|---|---|---|---|---|---|---|---|
| V-C | 1.727 | 1.067 | 22.9 | 0.851 | .702 | 14.6 × 23.6 | 0.787 | .899 | 16.1 × 27.6 |

In Examples VI and VII, a commercial 32 gauge two-bar single needle bed warp knitting machine is employed. Three beams of knitting yarn are fed. The back beam fully threads the back guide bar. A partial top beam nearly fills the front guide bar but leaves preselected spaced positions unthreaded. A partial middle beam feeds one end to each of the preselected spaced positions of the front guide bar, thus rendering it also fully threaded. Surface effect patterns formed in the knitted fabrics result when the ratio (R) of middle-beam to top-beam runner lengths is less than about 1.00. The intensity of the patterns also increases when, relative to the top-beam yarns, the middle-beam yarns retract more on relaxation from knitting tensions, shrink more during finishing, or are of quite different effective diameter.

EXAMPLE VI

Three fabrics are knitted, each having six Zones with different frequencies of middle-beam threads in the front guide bar as follows:

| | |
|---|---|
| Zone 1 | every fourth thread |
| Zone 2 | every fifth thread |
| Zone 3 | every sixth thread |
| Zone 4 | every seventh thread |
| Zone 5 | every eighth thread |
| Zone 6 | every ninth thread. |

Figures 1A, 1B, 1C, 1D, 1E, 1F, 1G, 1H, 1I, 1J:
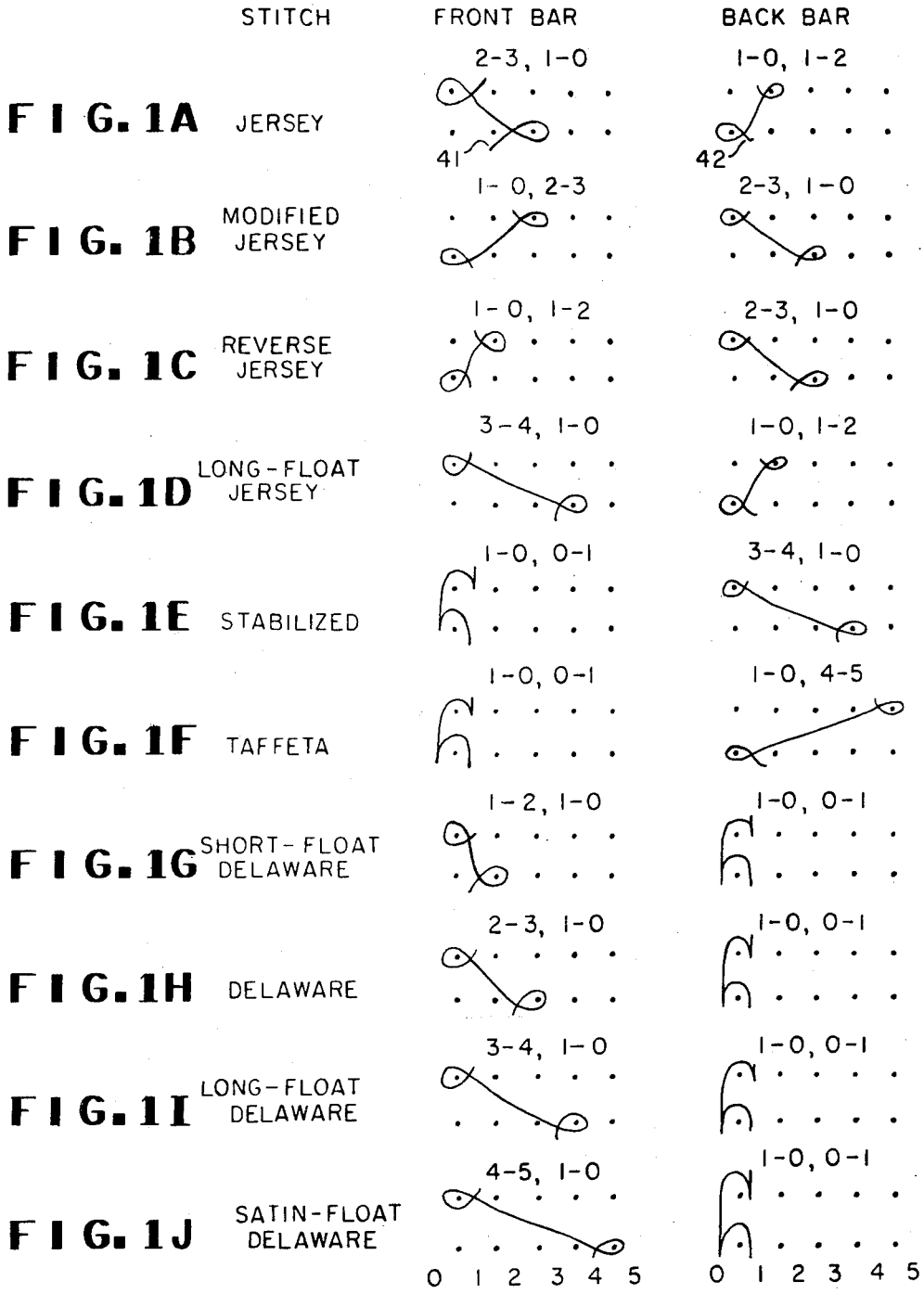
FIGS. 1A to 1J are stitch pattern diagrams for different types of basic warp-knitting with front and back bars of each stitch construction shown separately.
Figure 5:
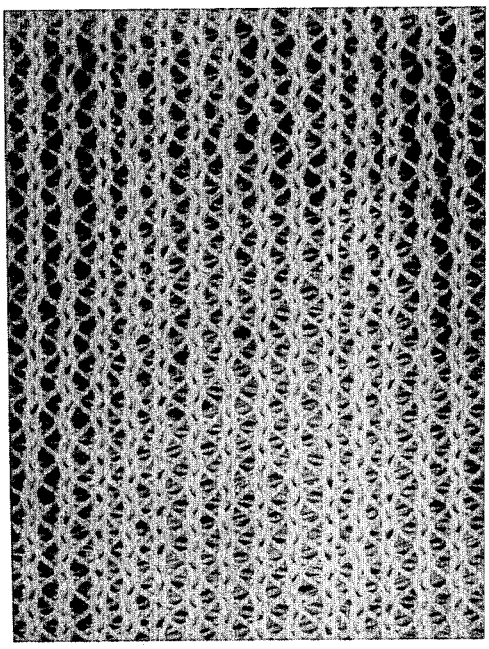
FIGS. 5, 6, and 7 are photographs of fabrics made as described in Example VI.
Figure 6:
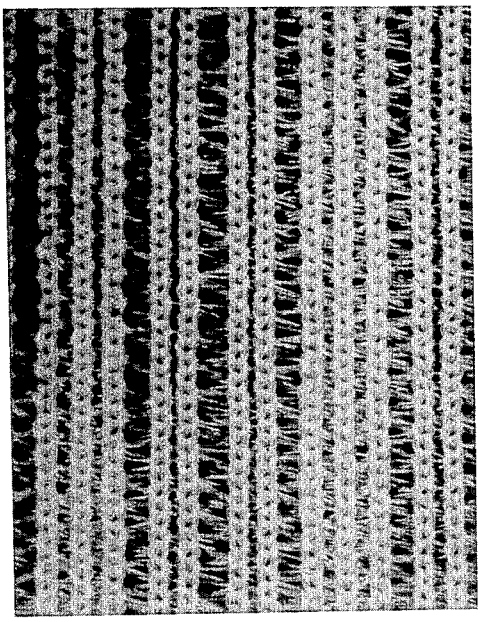
Figure 7:
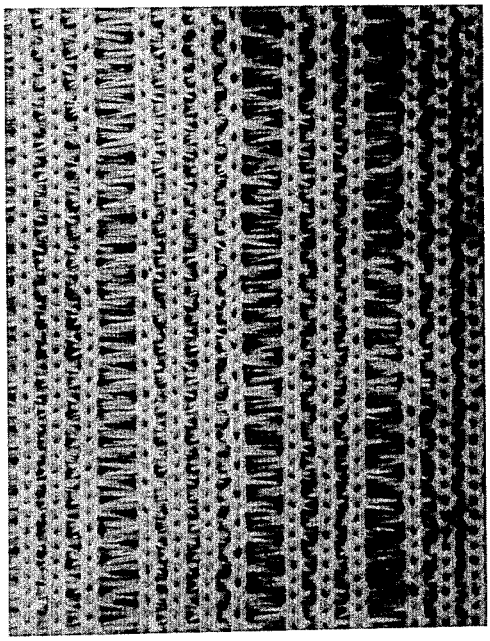

Fabric VI-A uses the Jersey stitch, FIG. 1A; Fabric VI-B the Delaware stitch, FIG, 1H; and Fabric VI-C the Long-Float Delaware stitch, FIG. 1I. Knitting parameters are shown in Table 2 and fabric characterizations in Table 3. FIGS. 5, 6, and 7 enlarged photographs of the three Zone 4 portions of Fabrics VI-A, VI-B, and VI-C, respectively. In Fabrics VI-A and VI-B, each middle-beam end is knitted into three adjacent wales, thus creating a distinguishable three-wale grouping. In Fabric VI-C, each middle beam end is knitted into four adjacent wales, thus creating a distinguishable four-wale grouping.

All of the walse of the Zones of Fabric VI-A have loops that are distorted in zig-zag fashion along each wale line (FIG. 5). The wales in each three-wale grouping are characterized as follows:

1. they tend to be slightly closer together than wales not included in three-wale groupings;
2. the outside two wales in each three-wale grouping have relatively normal loops in that they zig-zag very little along wale lines;
3. the center wale of each three-wale grouping is substantially identical to wales outside the grouping; and
4. wales occurring between three-wale groupings are identical, uniformly spaced from one another, and have sharply zig-zagged loops along each wale line.

The distorted stitches clearly differentiate this fabric from prior art Jersey fabrics, but the longitudinally striped effect of the three-wale groupings is rather subdued.

The two Delaware stitch fabrics (VI-B and VI-C) undergo wale shifting more readily with the result that sharply defined striped effects are produced by uniform wale groupings. In each case the individual wales closely resemble each other and are composed of tightened knit loops.

In Zones 1, 3, and 5, Fabric VI-B, the three-wale groupings alternate with one, three, and five wales, respectively, uniformly spaced from each other but set off from each three-wale grouping by an extra-wide interwale spacing. Each three-wale grouping is additionally split into two-wale and one-wale groupings by a slight widening of one interwale spacing.

In Zones 2, 4, and 6 of Fabric VI-B a quite different effect obtains. The wales in each three-wale grouping shift closer together and are evenly spaced. Also, the even number of extra wales between adjacent three-wale groupings shift to form the appropriate number of closely spaced two-wale groupings. Thus, Zone 2 has 3×2 wale groupings, Zone 4 (see FIG. 6) has 3×2×2 wale groupings, and Zone 6 has 3×2×2×2 wale groupings. The interwale spacings between adjacent groupings are all wide; i.e., at least as wide as the loop chains defining each wale.

Similar effects are obtained for fabric VI-C. Zone 1 has only tightly spaced four-wale groupings separated by extra-wide interwale spacings (about two wale-widths wide). Zone 4 (see FIG. 7), with three extra wales between four-wale groupings, has alternating wale-shifted four-wale and three-wale groupings all separated by extra-wide interwale spacings. In Zones 2, 3, 5, and 6 where the number of extra wales between four-wale groupings is not evenly divisible by three, different wale-shifting occurs. The four-wale groupings of Zones 2 and 5 split into two two-wale groupings with the result that 2×2×1 separate groupings form in Zone 2 and 2×2×1×2×1 separate groupings form in Zone 5. The four-wale groupings of Zones 3 and 6 split into one- and three-wale groupings with the result that 1×3×2 wale groupings form in Zone 3 and 1×3×2×1×2 wale groupings form in Zone 6.

It is apparent that, by varying the frequency with which middle-beam ends are fed to the front guide bar, a great variety of wale-shifted patterning effects can be obtained.

EXAMPLE VII

Six fabrics are prepared substantially as described in Example VI. All use front guide bars with every seventh position threaded by middle-beam yarn and the remaining positions threaded with top-beam yarn. With reference to Table 2, Fabrics VII-A, -C, and -E are all knit using Yarn B in the top and back beams and textured Yarn C in the middle beam. Fabrics VII-B, -D, and -F use the same top and back beams, but the middle beam feeds untextured Yarn A. With each of these two setups, again with reference to Table 2, a fabric is knitted using the Delaware stitch (Fabrics VII-A and VII-B), another is knitted using one modified Delaware stitch (Fabrics VII-C and VII-D), and third is knitted using a differently modified Delaware stitch.

The wale-shifted patterns obtained for Fabrics VII-A and VII-B are exactly as described in Example I for Zone 4 of Fabric VI-B (see FIG. 6).

In Fabrics VII-C and VII-D, the wales of each seven-wale repeat are wale-shifted into 3×1×3 wale groupings. The interwale spacing between adjacent three-wale groupings is very wide (about as wide as each three-wale grouping). The interwale spacings on either side of each one-wale grouping are unequal in width, smaller than the others, but strikingly distinct. Each wale is bowed, all in unison, to one side of the wale line with an eight-course repeat, giving the groupings a scalloped appearance which is very apparent in Fabric VII-C but less so in Fabric VII-D. Fabrics VII-E and VII-F have the 3×2×2 wale groupings of Fabrics VII-A and VII-B, the wales being more tightly shifted together within the groupings of Fabric VII-F. These fabrics also exhibit a slight scalloping of the wales as seen in Fabrics VII-C and VII-D.

spaced needle positions. In most of the examples, only every seventh end is doubled, the pattern being repeated across the full fabric width. In those fabrics whose numbers are marked with the symbol (#), the fabric has six zones across its width with each zone having a different spacing of doubled ends according to:

| | |
|---|---|
| Zone 1 | every fourth end doubled |
| Zone 2 | every fifth end doubled |
| Zone 3 | every sixth end doubled |
| Zone 4 | every seventh end doubled |
| Zone 5 | every eighth end doubled |
| Zone 6 | every ninth end doubled. |

The use of spaced doubled ends causes the creation of longitudinal patterning by uniform grouping of wales, the degree of patterning depending largely on the ratio (R) of middle bar to top bar runner lengths, i.e., differences in tension on the doubled ends. The lower this ratio, the greater the patterning effect. In addition, differences in retraction, shrinkage on finishing, and sizes of the doubled ends influence the degree of patterning. Tables of results in the examples list the fabrics prepared in descending order of the magnitudes of R.

Every fabric exemplified exhibits longitudinal striped patterning on its float side, these patterns being rather diffuse and generally devoid of clearcut interwale spacings. In the examples, patterning as viewed from the loop sides of the fabrics is discussed and compared.

TABLE 2

KNITTING PARAMETERS

| Fabric No. | Yarns Top Beam | Yarns Middle Beam | Yarns Back Beam | Runner Lengths (in.) Top | Runner Lengths (in.) Middle | Runner Lengths (in.) Back | Runner Lengths (m.) Top | Runner Lengths (m.) Middle | Runner Lengths (m.) Back | Stitch | Quality | R |
|---|---|---|---|---|---|---|---|---|---|---|---|---|
| VI-A | A | A | A | 62.5 | 56 | 36.5 | 1.588 | 1.422 | .927 | (1) | * | 0.90 |
| VI-B | A | A | A | 62 | 54 | 30.5 | 1.575 | 1.372 | .775 | (2) | * | 0.87 |
| VI-C | A | A | A | 73.5 | 58.75 | 30.25 | 1.867 | 1.492 | .768 | (3) | * | 0.80 |
| VII-A | B | C | B | 67 | 50.5 | 35 | 1.702 | 1.283 | .889 | (2) | ** | 0.75 |
| VII-B | B | A | B | 67 | 50.5 | 35 | 1.702 | 1.283 | .889 | (2) | ** | 0.75 |
| VII-C | B | C | B | 80.25 | 52.25 | 31 | 2.038 | 1.327 | .787 | (4) | * | 0.65 |
| VII-D | B | A | B | 80.25 | 52.25 | 31 | 2.038 | 1.327 | .787 | (4) | * | 0.65 |
| VII-E | B | C | B | 64.5 | 50 | 30 | 1.638 | 1.270 | .762 | (5) | * | 0.78 |
| VII-F | B | A | B | 64.5 | 50 | 30 | 1.638 | 1.270 | .762 | (5) | * | 0.78 |

* 6 in. (15.2 cm.)
** 8.25 in. (21.0 cm.)
(1) Jersey stitch 2-3,1-0/1-0,1-2
(2) Delaware stitch 2-3,1-0/1-0,0-1
(3) Long-float Delaware stitch 3-4,1-0/1-0,0-1
(4) Modified Delaware stitch 4-3,1-0(3-4,1-0)×2;3-4,6-7/1-0,1-0(1-0,0-1)×2;1-0,1-0
(5) Modified Delaware stitch 3-2,1-0(2-3,1-0)×2; 2-3,4-5/0-1,1-0(1-0,0-1)×2;1-0,1-0

TABLE 3

FABRIC CHARACTERIZATIONS

| Fabric No. | Finished Fabric Weight oz/yd² | Finished Fabric Weight gm/100 cm² | Finished Fabric Width in. | Finished Fabric Width m. | Finished Fabric Count (W/C) in.⁻¹ | Finished Fabric Count (W/C) cm.⁻¹ | Finished Fabric Bulk cc/gm | Greige Fabric Weight oz/yd² | Greige Fabric Weight gm/100 cm² | Greige Fabric Bulk cc/gm |
|---|---|---|---|---|---|---|---|---|---|---|
| VI-A | 2.3 | .781 | 67.5 | 1.715 | 39 × 67 | 15.4 × 26.4 | 4.91 | 2.4 | .814 | 6.46 |
| VI-B | 2.4 | .814 | 78.88 | 2.004 | 34 × 90 | 13.4 × 35.4 | 6.45 | 2.0 | .678 | 7.16 |
| VI-C | 2.7 | .916 | 78.5 | 1.994 | 34 × 88 | 13.4 × 34.6 | 4.36 | 2.5 | .848 | 6.28 |
| VII-A | 1.88 | .638 | 41.88 | 1.064 | 33 × 70 | 13.0 × 27.6 | 6.53 | 1.67 | .567 | 7.29 |
| VII-B | 2.10 | .713 | 74.5 | 1.892 | 35 × 75 | 13.8 × 29.5 | 6.35 | 1.71 | .580 | 5.26 |
| VII-C | 2.41 | .818 | 41.32 | 1.050 | 33 × 90 | 13.0 × 35.4 | 5.31 | 2.58 | .876 | 7.26 |
| VII-D | 2.83 | .960 | 72.75 | 1.848 | 38 × 88 | 14.9 × 34.6 | 6.56 | 2.5 | .848 | 6.35 |
| VII-E | 2.24 | .760 | 41.75 | 1.060 | 33 × 92 | 13.0 × 36.2 | 6.69 | 2.16 | .733 | 7.59 |
| VII-F | 2.62 | .889 | 75.5 | 1.918 | 35 × 100 | 13.8 × 39.4 | 6.89 | 2.10 | .713 | 7.31 |

In Examples VIII, IX, X, and XI, a commercial 32-gauge two-bar single needle bed warp knitting machine is employed. The top beam and the back beam are provided with the same kind of knitting yarn, each fully threading the respective guide bars. A third partial beam is employed, feeding the same or different knitting yarns as shown in Tables 4, 6, and 8. Each end from the middle (partial) beam is doubled with an end from the top beam, the two being led through the same guide in the front guide bar and knitted together as a single end. Doubled ends in the front guide bar are at

EXAMPLE VIII

This example compares fabrics made using the Delaware stitch which has a 2-3,1-0 repeated front bar stitch and a back bar chain stitch (mostly 1-0,0-1 open chain, but also 0-1,1-0 open chain and 0-1,0-1 closed chain as indicated in Tables 1 and 2). Patterning effects appear to be independent of which chain stitch is used in the back bar. Data relevant to knitting of the fabrics are given in Table 4; fabric characterizations are in Table 5.

Little or no patterning is evident on the loop face of Fabric VIII-A except for enlargement and distortion of every seventh wale. Fabric VIII-B shows little or no shifting of wale spacings but nevertheless has a muted longitudinally striped effect in which three-wale groupings with relatively opaque interwale spacings are separated by four normally knit and spaced wales each bounded by relatively open interwale spacings. In these and all the remaining fabrics of this example, the three-wale groupings correspond to the 3-needle floats of each doubled front-bar end.

Fabric VIII-C introduces a new patterning effect in that, in addition to the readily distinguishable three-wale groupings, the four intervening wales undergo wale shifting to form two two-wale groupings of close wales, each two-wale grouping separated from the adjacent two-wale and three-wale groupings by extra-wide more open interwale spacings.

Fabric VIII-D, using the same yarns as Fabric VIII-A, is very similar in appearance to Fabric VIII A. The lack of clear patterning for this fabric is unexplained.

Figure 8:
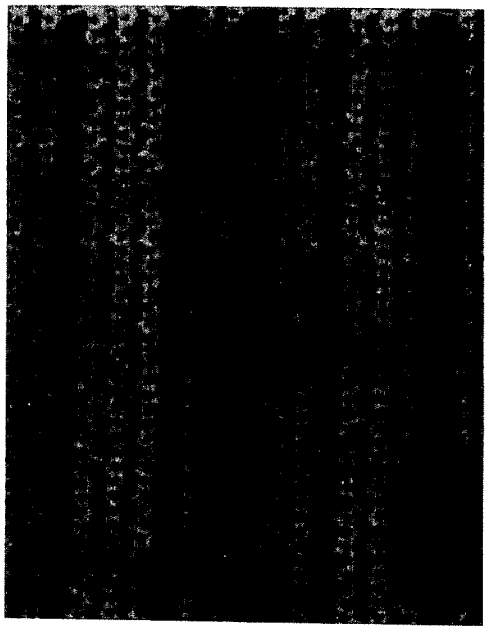
FIGS. 8, 9, and 10 are photographs of fabrics made as described in Examples VIII, IX, and X, respectively.

Fabrics VIII-E through VIII-M (comparing only Zone 4 of Fabric VIII-F) have the same 3×2×2 wale-shifted pattern as described for Fabric VIII-C. As R decreases, the wales in each grouping move closer together, the interwale spacings between groupings become wider and and relatively more open, and the patterns become sharper and more striking. FIG. 8 is an enlarged photograph of the Fabric VIII-F (Zone 4) typifying the patterning described.

Fabric VIII-F illustrates patterning changes accompanying different frequencies of doubled ends. Zone 1 has three-wale groupings alternating with single wales set off by widened interwale spacings. In Zone 2, the two wales between the three-wale groupings are shifted close together with extra-wide interwale spacings between three- and two-wale groupings. Zone 3 has three normally spaced wales between the three-wale groupings. Zone 4 (discussed above) has four wales between three-wale groupings which are wale-shifted to form two-wale groupings. Zone 5 has five normally spaced wales between three-wale groupings. Zone 6 has three wale-shifted two-wale groupings between three-wale groupings. It is apparent that, when an even number of wales devoid of doubled ends are left between the three-wale groupings including doubled ends, the intervening wales shift to provide regular two-wale groupings which are stable and uniform throughout the fabric length.

TABLE 4

KNITTING PARAMETERS
DELAWARE STITCH (2-3,1-0/1-0,0-1)

| Fabric No. | Yarns Top Beam | Yarns Middle Beam | Yarns Back Beam | Runner Lengths (in.) Top | Runner Lengths (in.) Middle | Runner Lengths (in.) Back | Runner Lengths (m.) Top | Runner Lengths (m.) Middle | Runner Lengths (m.) Back | Quality (in.) | Quality (cm.) | R middle/top |
|---|---|---|---|---|---|---|---|---|---|---|---|---|
| VIII-A | B | A | B | 51.5 | 84 | 33 | 1.308 | 2.134 | .838 | 6 | 15.2 | 1.63 |
| VIII-B | A | A | A | 56 | 61 | 30.5 | 1.422 | 1.549 | .775 | 6 | 15.2 | 1.09 |
| VIII-C | A | A | A | 55 | 55 | 30.5 | 1.397 | 1.397 | .775 | 6 | 15.2 | 1.00 |
| VIII-D | B | A | B | 51 | 49 | 34 | 1.295 | 1.245 | .864 | 6 | 15.2 | 0.96 |
| VIII-E | A | A | A | 56 | 51 | 30.5 | 1.422 | 1.295 | .775 | 6 | 15.2 | 0.91 |
| VIII-F**No. | A | A | A | 56.75 | 47 | 31.25 | 1.378 | 1.194 | .794 | 6 | 15.2 | 0.83 |
| VIII-G* | B | C | B | 55.5 | 42.5 | 30 | 1.410 | 1.080 | .762 | 6 | 15.2 | 0.77 |
| VIII-H | A | A | A | 56 | 43 | 30.5 | 1.422 | 1.092 | .775 | 6 | 15.2 | 0.77 |
| VIII-I | B | A | B | 55.5 | 42.5 | 30 | 1.410 | 1.080 | .762 | 6 | 15.2 | 0.77 |
| VIII-J* | B | C | B | 61 | 42.5 | 30 | 1.549 | 1.080 | .762 | 6 | 15.2 | 0.70 |
| VIII-K | B | A | B | 56 | 39 | 34 | 1.422 | .991 | .864 | 6 | 15.2 | 0.70 |
| VIII-L | B | A | B | 61 | 42.5 | 30 | 1.549 | 1.080 | .762 | 6 | 15.2 | 0.70 |
| VIII-M | A | A | A | 61 | 43 | 30.5 | 1.549 | 1.092 | .775 | 6 | 15.2 | 0.70 |

*Backbar stitch 0-1,1-0 open chain
**Backbar stitch 0-1,0-1 closed chain

TABLE 5

FABRIC CHARACTERIZATIONS - DELAWARE STITCH

| Fabric No. | Finished Fabric Weight oz./yd.² | Finished Fabric Weight gm./100 cm.² | Finished Fabric Width in. | Finished Fabric Width m. | Finished Fabric Count (W×C) in.⁻¹ | Finished Fabric Count (W×C) cm.⁻¹ | Finished Fabric Bulk (cc/gm) | Greige Fabric Weight oz/yd² | Greige Fabric Weight gm/100 cm² | Greige Fabric Bulk cc/gm. |
|---|---|---|---|---|---|---|---|---|---|---|
| VIII-A | 2.70 | .916 | 70.75 | 1.797 | 38 × 90 | 15.0 × 35.4 | 6.38 | 2.30 | .781 | 4.90 |
| VIII-B | 2.4 | .814 | 78.5 | 1.994 | 34 × 90 | 13.4 × 35.4 | 5.06 | 2.1 | .713 | 6.09 |
| VIII-C | 2.3 | .781 | 78.25 | 1.988 | 34 × 96 | 13.4 × 37.8 | 4.42 | 2.1 | .713 | 5.03 |
| VIII-D | 2.45 | .831 | 73.5 | 1.867 | 36 × 95 | 14.2 × 37.4 | 4.07 | 2.20 | .747 | 4.10 |
| VIII-E | 2.4 | .814 | 78.25 | 1.988 | 34 × 90 | 13.4 × 35.4 | 4.78 | 2.1 | .713 | 5.51 |
| VIII-F No. | 2.4 | .814 | 78 | 1.981 | 34 × 89 | 13.4 × 35.0 | 4.29 | 2.2 | .747 | 6.53 |
| VIII-G | 2.28 | .774 | 41.25 | 1.048 | 32 × 98 | 12.6 × 38.6 | 5.29 | 2.22 | .753 | 6.54 |
| VIII-H | 2.5 | .848 | 78.25 | 1.988 | 34 × 99 | 13.4 × 39.0 | 5.04 | 2.1 | .713 | 6.12 |
| VIII-I | 2.68 | .909 | 72.5 | 1.842 | 37 × 94 | 14.6 × 37.0 | 5.39 | 2.10 | .713 | 5.58 |
| VIII-J | 2.53 | .859 | 42.33 | 1.075 | 33 × 96 | 13.0 × 37.8 | 5.77 | 2.24 | .760 | 6.85 |
| VIII-K | 2.54 | .862 | 70.83 | 1.799 | 37 × 86 | 14.6 × 33.9 | 5.01 | 2.20 | .747 | 4.83 |
| VIII-L | 2.88 | .977 | 72.5 | 1.842 | 38 × 100 | 15.0 × 39.4 | 6.03 | 2.20 | .747 | 5.43 |
| VIII-M | 2.4 | .814 | 78.5 | 1.994 | 34 × 86 | 13.4 × 33.9 | 6.35 | 2.1 | .713 | 7.00 |

EXAMPLE IX

Figure 9:
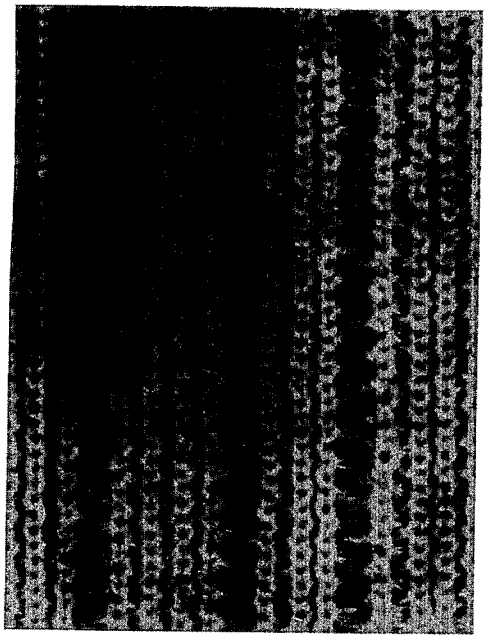

Tables 6 and 7 characterize fabrics prepared as described in Example VIII except for use of the Long- Float Delaware knitting stitch. This stitch uses a 3-4,1-0 knitting pattern for the front bar and a chain stitch for the back bar. Because each doubled end becomes knitted into four wales, four-wale groupings analogous to the three-wale groupings of Examples VIII are formed when R is sufficiently low. Zone 4 of Fabric IX-A and the whole widths of the remaining fabrics of this example have doubled ends at every seventh position of the front guide bar. FIG. 9 is typical of the wale shifted patterned effects of these fabrics (Zone 4 of Fabric IX-A). The tightness with which wales are shifted together within the groupings, and the width of interwale spacings between groupings, increase with decreasing R. All of these fabrics exhibit tight four-wale groupings including the doubled ends alternating with tight three-wale groupings devoid of doubled ends.

Figure 10:
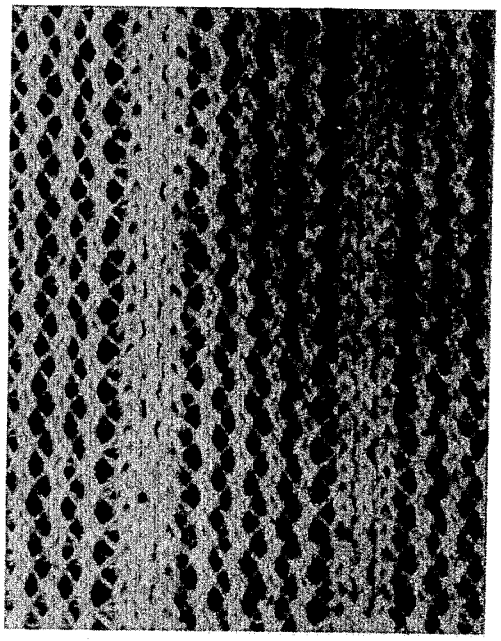

Fabric IX-A illustrates the effect of varying the frequency of doubled ends. Zone 1 has repetitive four-wale groupings across its width with extra-wide interwale spacings between the groupings. Zone 2 has four-wale groupings alternating with spaced single wales. In Zone 3, four-wale groupings alternate with tight two-wale groupings. Zone 4, as above described, has 4×3 wale groupings. Zone 5, unexpectedly, has 4×1×2×1 groupings, and Zone 6 has 4×2×1×2 groupings. While not included in the examples, when every tenth end is crossed the groupings in repetitive sequence are 4×3×3 indicating the natural tendency for Long-Float Delaware stitch to form only three-wale groupings between four-wale groupings when the number of wales available is divisible by 3. It is of further interest that the four-wale groupings of Zones 2 and 5 are slightly separated into two two-wale groupings.

for the back bar. Because each doubled end becomes knitted into three wales, three-wale groupings analogous to the three-wale groupings of Example VIII are formed when R is sufficiently low. Zone 4 of Fabric X-H and the whole widths of the remaining fabrics of this example have doubled ends at every seventh position of the front guide bar. FIG. 10 (Fabric X-I) shows the type of patterning obtainable using Jersey stitch. The tightness with which wales are shifted together in the three-wale groupings and the extent of zig-zag distortion of remaining wales increase with decreasing R.

The loop faces of Fabrics X-A and X-B are barely distinguishable from Jersey knits made without any doubled ends. No clearcut three-wale groupings occur. Regular three-wale groupings are distinguishable in Fabric X-E, but without noticeable wale shifting. Fabric X-F is also very similar, its three-wale groupings being more clearly distinguished.

Fabrics X-D represents an intermediate type of patterning in which a single wale of each three-wale grouping is set off from remaining wales by extra-wide interwale spacings and the six wales between nearest set-off wales are substantially normally knit and spaced.

Fabrics X-G through X-J all exhibit the same patterning, its intensity increasing with decreasing R. First, the stitches in each wale are distorted in zig-zag fashion walewise. Second, the wales in each three-wale grouping shift closer together. Finally, the tighter the three-wale groupings associate, the less do their stitches appear distorted. Simultaneously, the four evenly spaced wales between consecutive three-wale groupings become more distorted. Preferred patterns result when R is less than or about 1.00.

TABLE 6

KNITTING PARAMETERS
LONG-FLOAT DELAWARE STITCH (3–4,1–0/1–0,0–1)

| Fabric No. | Yarns Top Beam | Yarns Middle Beam | Yarns Back Beam | Runner Lengths (in.) Top | Runner Lengths (in.) Middle | Runner Lengths (in.) Back | Runner Lengths (m) Top | Runner Lengths (m) Middle | Runner Lengths (m) Back | Quality (in) | Quality (cm.) | R middle/top |
|---|---|---|---|---|---|---|---|---|---|---|---|---|
| IX-A No. | A | A | A | 75 | 61 | 32 | 1.905 | 1.549 | .813 | 6 | 15.2 | 0.81 |
| IX-B | A | A | A | 74.5 | 56 | 34 | 1.892 | 1.422 | .864 | 6 | 15.2 | 0.75 |
| IX-C | A | A | A | 77 | 56 | 34 | 1.956 | 1.422 | .864 | 6 | 15.2 | 0.73 |
| IX-D | A | A | A | 76 | 54 | 34 | 1.930 | 1.372 | .864 | 6 | 15.2 | 0.71 |
| IX-E | B | A | B | 84 | 52 | 31 | 2.134 | 1.321 | .787 | 6 | 15.2 | 0.62 |
| IX-F* | B | C | B | 84 | 52 | 31 | 2.134 | 1.321 | .787 | 6 | 15.2 | 0.62 |

*Backbar stitch 0–1,1–0 open chain

TABLE 7

FABRIC CHARACTERIZATIONS - LONG-FLOAT DELAWARE STITCH

| Fabric No. | Finished Fabric Weight oz/yd² | Finished Fabric Weight gm/100 cm² | Finished Fabric Width in. | Finished Fabric Width m. | Finished Fabric Count (W×C) in.⁻¹ | Finished Fabric Count (W×C) cm.⁻¹ | Finished Fabric Bulk (cc/gm) | Greige Fabric Weight oz/yd² | Greige Fabric Weight gm/100cm² | Greige Fabric Bulk cc/gm. |
|---|---|---|---|---|---|---|---|---|---|---|
| IX-A No. | 2.95 | 1.001 | 78.5 | 1.994 | 34 × 88 | 13.4 × 34.6 | 5.41 | 2.5 | .848 | 6.48 |
| IX-B | 2.8 | .950 | 78.25 | 1.988 | 34 × 86 | 13.4 × 33.9 | 5.17 | 2.5 | .848 | 6.00 |
| IX-C | 2.8 | .950 | 78.25 | 1.988 | 34 × 86 | 13.4 × 33.9 | 6.02 | 2.6 | .882 | 6.34 |
| IX-D | 2.8 | .950 | 78.25 | 1.988 | 34 × 90 | 13.4 × 35.4 | 5.57 | 2.5 | .848 | 6.22 |
| IX-E | 3.3 | 1.120 | 73.5 | 1.867 | 36 × 92 | 14.2 × 36.2 | 6.81 | 2.6 | .882 | 6.00 |
| IX-F | 2.91 | .988 | 43.88 | 1.115 | 32 × 93 | 12.6 × 36.6 | 6.67 | 2.77 | .940 | 7.19 |

EXAMPLE X

Tables 7 and 8 characterize fabrics prepared as described in Examples VIII and IX except for the use of the Jersey knitting stitch. This stitch uses a 2-3,1-0 knitting pattern for the front bar and a 1-0,1-2 pattern Fabric X-H illustrates the effect of varying the frequency of doubled ends. No extra wale shifting between three-wale groupings occurs, nor is any change in zig-zag distortion of the stitches observed due only to the changes in frequency. Instead, the number of evenly spaced wales between three-wale groupings increases regularly from Zone 1 to Zone 6.

TABLE 8

| Fabric No. | Top Beam | Middle Beam | Back Beam | KNITTING PARAMETERS JERSEY STITCH (2-3,1-0/1-0,1-2) Runner Lengths (in.) Top | Middle | Back | Runner Lengths (m.) Top | Middle | Back | Quality (in.) | (cm.) | R middle/top |
|---|---|---|---|---|---|---|---|---|---|---|---|---|
| X-A | B | C | B | 55 | 82 | 42.5 | 1.397 | 2.083 | 1.080 | 7 | 17.8 | 1.49 |
| X-B | B | A | B | 55 | 82 | 42.5 | 1.397 | 2.083 | 1.080 | 7 | 17.8 | 1.49 |
| X-C | A | A | A | 55 | 82 | 42.5 | 1.397 | 2.083 | 1.080 | 7 | 17.8 | 1.49 |
| X-D | B | A | B | 56 | 72.5 | 43 | 1.422 | 1.842 | 1.092 | 8.25 | 21.0 | 1.29 |
| X-E | A | A | A | 55 | 70 | 42.5 | 1.397 | 1.778 | 1.080 | 7 | 17.8 | 1.29 |
| X-F | A | A | A | 55 | 60 | 42.5 | 1.397 | 1.524 | 1.080 | 7 | 17.8 | 1.09 |
| X-G | A | A | A | 72.25 | 68 | 45.75 | 1.835 | 1.727 | 1.162 | 10 | 25.4 | 0.94 |
| X-H* | A | A | A | 62.5 | 56 | 36.5 | 1.588 | 1.422 | .927 | 6 | 15.2 | 0.90 |
| X-I | B | C | B | 72.25 | 45.75 | 37.25 | 1.835 | 1.162 | .946 | 7 | 17.8 | 0.63 |
| X-J | B | A | B | 72.25 | 45.75 | 37.25 | 1.835 | 1.162 | .946 | 10 | 25.4 | 0.63 |

TABLE 9

| Fabric No. | FABRIC CHARACTERIZATIONS - JERSEY STITCH Finished Fabric Weight oz/yd² | gm/100 cm² | Width in. | m. | Count (W×C) in.⁻¹ | cm.⁻¹ | Bulk cc/gm | Greige Fabric Weight oz/yd² | gm/100cm² | Bulk cc/gm. |
|---|---|---|---|---|---|---|---|---|---|---|
| X-A | 2.23 | .757 | 26.75 | .679 | 40 × 59 | 15.7 × 23.2 | 5.51 | 2.32 | .787 | 5.65 |
| X-B | 2.74 | .930 | 54.25 | 1.378 | 48 × 62 | 18.9 × 24.4 | 5.71 | 2.40 | .814 | 4.60 |
| X-C | 2.2 | .747 | 66.75 | 1.695 | 39 × 63 | 15.4 × 24.8 | 5.90 | 2.3 | .781 | 6.46 |
| X-D | 2.24 | .760 | 54.75 | 1.391 | 48 × 56 | 18.9 × 22.0 | 4.55 | 2.00 | .679 | 4.90 |
| X-E | 2.2 | .747 | 67 | 1.702 | 39 × 62 | 15.4 × 24.4 | 5.22 | 2.2 | .747 | 5.68 |
| X-F | 2.1 | .713 | 67.25 | 1.708 | 38 × 67 | 15.0 × 26.4 | 4.20 | 2.2 | .747 | 5.02 |
| X-G | 2.0 | .679 | 67.75 | 1.721 | 38 × 52 | 15.0 × 20.5 | 5.64 | 1.9 | .645 | 7.01 |
| X-H No. | 2.3 | .781 | 67.75 | 1.721 | 39 × 68 | 15.4 × 26.8 | 5.03 | 2.5 | .848 | 6.48 |
| X-I | — | — | — | — | — | — | — | — | — | — |
| X-J | 3.21 | 1.089 | 54.75 | 1.391 | 49 × 69 | 19.3 × 27.2 | 6.39 | 2.7 | .916 | 6.48 |

EXAMPLE XI

This example illustrates that the partially doubled ended warp knitting process is also capable of creating longitudinal wale-grouped patterns when more complicated knitting stitches are employed. Except for the different stitch employed, this example duplicates the knitting arrangement of the previous examples, VIII, IX, and X, every seventh end being doubled at the front bar. The front bar stitch is 1-0,1-0, 2-3,1-0 and the back bar stitch is the 1-0,0-1 open chain. Yarn A is used throughout, and $R = 0.88$.

Top runner length = 53.5 in (1.359 m)
Middle runner length = 47 in (1.194 m)
Back runner length = 30,25 in (0.768 m)
Quality = 6 in (15.2 cm) Greige weight = 2.0 oz/yd² (0.679 gm/100 cm²)
Greige bulk = 6.53 cc/gm
Finished weight = 2.3 oz/yd² (0.781 gm/100 cm²)
Finished width = 78.5 in (1.994 m)
Finished count = 34×88 in⁻¹ (13.4×34.6 cm⁻¹)
Finished bulk = 5.71 cc/gm The muted but clear pattern obtained consists of close three-wale groupings alternating with groups of four uniformly spaced wales.

EXAMPLE XII

Nine additional fabrics are prepared as in Examples VI and VII to illustrate wale-shifted surface patterning effects for R greater then unity, and to compare with fabrics knitted at R less than unity. Yarn A is used in all three beams. The back guide bar is fully threaded from the bottom beam, and the front guide bar is fully threaded from the top and middle beams. In the front guide bar, every seventh end comes from the middle beam, and the intervening groups of six ends come from the top beam. Fabrics XII-A, -B, and -C use the Jersey stitch, FIG. 1A; Fabrics XII-D, E, and -F use the Delaware stitch, FIG. 1H; and Fabrics XII-G, -H, and -I use the Long Float Delaware stitch, FIG. II.

Considering the Jersey fabrics first, Fabric XII-C ($R = 0.82$) has a pattern, repeated across its whole width, in which groups of three adjacent wales are shifted close together and the groups are separated by four normally knit and spaced wales. Fabrics XII-A ($R = 1.29$) and XII-B ($R = 1.45$) are almost identical in patterning but completely different from Fabric XII-C. In each the patterning of consecutive wales is as follows: Two wales of alternating large and small loops flank a normally knit wale and are wale-shifted away from it to provide widened relatively open spaces. This three-wale pattern is repeated in every group of seven wales across the width of the fabric. The interventing groups of four wales each also wale-shift slightly such that the two outside wales in each group of four are very close to the three-wale patterns and slightly spaced apart from the two remaining central wales. These fabrics exhibit a pleasing surface patterning not heretofore obtainable in basic Jersey warp knitting.

Delaware stitch Fabric XII-D ($R = 0.79$) is substantially identical in appearance to the one shown in FIG. 6; i.e., it has repeating 3×2×2 wale-shifted groupings separated by relatively open interwale spacings. Fabrics XII-E ($R = 1.23$) and XII-F ($R = 1.29$) are indistinguishable from one another but differ from Fabric XII-D in that 2×1×2×2 repetitive patterns of wale-shifted groupings occur across their widths.

Long Float Delaware stitch Fabric XII-G ($R = 0.75$) is substantially identical in appearance to the one shown in FIG. 7; i.e., it has repeating 4×3 wale-shifted groupings separated by relatively open interwale spacings. Fabrics XII-H ($R = 1.07$) and XII-I ($R = 1.21$) are very similar to each other in patterning but strikingly different from Fabric XII-G. The relatively open interwale spacings formed by wale-shifting are not each as wide as in Fabric XII-G, but are more numerous. The repeated pattern of groupings in each case is 2×1×1×2×1. Fabric XII-I is considerably more distinctly patterned than is Fabric XII-H.

It is shown for this mixed-feeding technique that:

1. limited overfeeding of the minor partial beam produces excellent wale-shifted patterning;

2. patterns formed with R greater than unity differ from those formed with R less than unity; and 3. as R approaches unity with identical feed yarns, patterning becomes less distinct.

TABLE 10

| Fabric No. | Yarns Top Beam | Yarns Middle Beam | Yarns Back Beam | KNITTING PARAMETERS Runner Lengths (in.) Top | Runner Lengths (in.) Middle | Runner Lengths (in.) Back | Runner Lengths (m.) Top | Runner Lengths (m.) Middle | Runner Lengths (m.) Back | Quality (in.) | Quality (cm.) | R |
|---|---|---|---|---|---|---|---|---|---|---|---|---|
| XII-A | A | A | A | 56 | 72.5 | 43 | 1.422 | 1.842 | 1.092 | 8.25 | 21.0 | 1.29 |
| XII-B | A | A | A | 58 | 84 | 43 | 1.473 | 2.134 | 1.092 | 8.25 | 21.0 | 1.45 |
| XII-C | A | A | A | 60 | 49.5 | 43 | 1.524 | 1.257 | 1.092 | 8.25 | 21.0 | 0.82 |
| XII-D | A | A | A | 57 | 45 | 31.5 | 1.448 | 1.143 | 0.800 | 6 | 15.2 | 0.79 |
| XII-E | A | A | A | 53 | 65 | 31.5 | 1.346 | 1.651 | 0.800 | 6 | 15.2 | 1.23 |
| XII-F | A | A | A | 55 | 71 | 31.5 | 1.397 | 1.803 | 0.800 | 6 | 15.2 | 1.29 |
| XII-G | A | A | A | 76 | 57 | 31.5 | 1.930 | 1.448 | 0.800 | 6 | 15.2 | 0.75 |
| XII-H | A | A | A | 68 | 73 | 31.5 | 1.727 | 1.854 | 0.800 | 6 | 15.2 | 1.07 |
| XII-I | A | A | A | 70 | 85 | 31.5 | 1.778 | 2.159 | 0.800 | 6 | 15.2 | 1.21 |

TABLE 11

| Fabric No. | FABRIC CHARACTERIZATIONS Finished Fabric Weight oz/yd² | Weight gm./100 cm² | Width in. | Width m. | Count (W/C) in.⁻¹ | Count (W/C) cm.⁻¹ | Bulk cc/gm. | Greige Fabric Weight oz./yd.² | Weight gm./100 cm² | Bulk cc/gm. |
|---|---|---|---|---|---|---|---|---|---|---|
| XII-A | 2.4 | .814 | 58.75 | 1.492 | 45 × 62 | 17.7 × 24.4 | 5.24 | 2.04 | .692 | 4.78 |
| XII-B | 2.4 | .814 | 60.12 | 1.527 | 43 × 64 | 16.9 × 25.2 | 6.25 | 2.37 | .804 | 5.37 |
| XII-C | 2.4 | .814 | 59.5 | 1.511 | 44 × 62 | 17.3 × 24.4 | 4.58 | 2.17 | .736 | 5.18 |
| XII-D | 2.3 | .781 | 72.75 | 1.848 | 36 × 90 | 14.2 × 35.4 | 4.71 | 2.40 | .814 | 5.00 |
| XII-E | 2.5 | .848 | 72.75 | 1.848 | 36 × 95 | 14.2 × 37.4 | 4.68 | 2.40 | .814 | 4.67 |
| XII-F | 2.4 | .814 | 73.5 | 1.867 | 37 × 91 | 14.6 × 35.8 | 5.31 | 2.09 | .709 | 5.74 |
| XII-G | 2.8 | .950 | 75.5 | 1.918 | 36 × 93 | 14.2 × 36.6 | 5.07 | 1.91 | .648 | 5.87 |
| XII-H | 2.8 | .950 | 73.12 | 1.857 | 37 × 90 | 14.6 × 35.4 | 4.45 | 2.02 | .686 | 5.20 |
| XII-I | 2.8 | .950 | 73.62 | 1.870 | 37 × 90 | 14.6 × 35.4 | 5.31 | 1.99 | .675 | 4.89 |

What is claimed is:

1. A warp knitted fabric at least a portion of which comprising: at least two full sets of threads knitted in courses according to a stitch pattern forming spaced wales of knitted loops, said portion of said fabric having a continuous pattern throughout its length of at least one group of wales, said group of wales, said group being separated from adjacent wales by exaggerated spacing.

2. The fabric of claim 1, said knotted loops varying course-wise in shape, size, orientation and in spacing in a sequence which repeats in alternate courses.

3. The fabric as defined in claim 2, there being a plurality of groups, each group having in the range of from one to five wales.

4. The fabric as defined in claim 3, said pattern being repeated.

5. The fabric of claim 1, said warp threads being knit as a Jersey stitch pattern.

6. The fabric of claim 1, said warp threads being knit as a Modified Jersey stitch pattern.

7. The fabric of claim 1, said stitches being knit with a float stitch in the front bar and chain stitch on the back bar stitch pattern.

8. A warp knitted fabric comprising: full sets of front and back bar warp threads of yarn knitted in courses according to a stitch pattern forming spaced wales of knitted loops, said fabric having a continuous pattern throughout its length of at least one group of wales, said group being separated from adjacent wales by exaggerated spacings, said knitted loops varying course-wise in shape, size, orientation, and in spacing in a sequence which repeats in alternate courses.

9. A two bar warp knitted fabric comprising: full sets of front and back bar threads of non-elastomeric yarn knitted in courses according to a stitch pattern forming spaced wales of generally uniformly sized knitted loops with generally uniform interwale spacing, said fabric having located therein a continuous pattern throughout its length of a least one group of wales, said group being separated from adjacent wales by exaggerated interwale spacing contrasting with said uniform interwale spacing, said knitted loops in said pattern varying course-wise in shape, size, orientation, and in spacing in a sequence which repeats in alternate courses in said pattern.

10. The fabric of claim 9, said front and back bar threads being knit as a Jersey stitch with a (2-3,1-0) front bar stitch pattern and a (1-0,1-2) back bar stitch pattern.

11. The fabric of claim 9, said front and back bar threads being knit as a Modified Jersey stitch with a (1-0,2-3) front bar stitch pattern and a (2-3,1-0) back bar stitch pattern.

12. The fabric of claim 9, said front and back bar threads being knit with a (2-3,1-0) front bar stitch pattern and a (1-0,0-1) back bar stitch pattern.

13. The fabric of claim 9, said front and back bar threads being knit with a (3-4,1-0) front bar stitch pattern and a (1-0,0-1) back bar stitch pattern.

* * * * *

UNITED STATES PATENT OFFICE

CERTIFICATE OF CORRECTION

PATENT NO. : 4,015,451

DATED : April 5, 1977

INVENTOR(S) : Bharat Jaybhadra Gajjar

It is certified that error appears in the above-identified patent and that said Letters Patent are hereby corrected as shown below:

Col. 1, line 56, insert -- pattern -- after "under".

Col. 3, line 27, change "alternative" to -- alternate --.

Col. 3, line 46, change "strips" to -- stripes --.

Col. 4, line 16, change "a" to -- as --.

Col. 8, line 14, change "or" to -- of --.

Col. 9, line 44, insert -- are -- after "7".

Col. 9, line 52, change "walse" to -- wales --.

Col. 11, line 3, insert -- a -- after "and".

Col. 14, line 6, delete "and" in first instance.

Col. 14, line 19, insert -- two -- after "form".

Col. 15, line 27, change "crossed" to read -- doubled --.

Col. 17, line 46, put "Greige weight = 2.0 oz/yd$^2$ (0.679 gm/100 cm$^2$)" on separate line.

Col. 17, line 60, change "then" to -- than --.

Col. 18, line 32, change "Fig. II" to -- Fig. 1I --.

Col. 18, line 45, change "interventing" to -- intervening --.

Col. 19, line 49, delete "said group of wales".

Col. 19, line 51, change "knotted" to -- knitted --.

UNITED STATES PATENT OFFICE

CERTIFICATE OF CORRECTION

PATENT NO. : 4,015,451

DATED : April 5, 1977

INVENTOR(S) : Bharat Jaybhadra Gajjar

It is certified that error appears in the above-identified patent and that said Letters Patent are hereby corrected as shown below:

Col. 20, line 43, change "throught-" to -- through- --.

Col. 20, line 44, change "a" to -- at --.

Table 1a, Fabric I-A, Runner Length, Back Bar: change "1.467" to -- 1.461 --.

Table 3, Unbroken line under both "Finished Fabric" and "Greige Fabric". Only last 3 columns should be under "Greige Fabric".

Table 4, 1st column, "VIII-FNo." should read -- VIII-F# --.

Table 5, 1st column, "VIII-F No." should read -- VIII-F# --.

Tables 6 and 7, 1st column, "IX-A No." should read -- IX-A# --.

Table 8, 1st column, "X-H*" should read -- X-H# --.

Table 9, 1st column, "X-H No." should read -- X-H# --.

Signed and Sealed this second Day of August 1977

[SEAL]

Attest:

RUTH C. MASON
Attesting Officer

C. MARSHALL DANN
Commissioner of Patents and Trademarks